US006726494B1

(12) United States Patent
Tai et al.

(10) Patent No.: US 6,726,494 B1
(45) Date of Patent: Apr. 27, 2004

(54) EXTRACTION TAB FOR EXTRACTING ELECTRICAL CONNECTOR

(75) Inventors: Lung-Sheng Tai, Tu-Chen (TW); Chia-Ming Kuo, Tu-Chen (TW); Zhen-Da Hung, Tu-Chen (TW); Hsien-Chu Lin, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/629,231

(22) Filed: Jul. 28, 2003

(30) Foreign Application Priority Data

May 23, 2003 (TW) ..... 92209559 U

(51) Int. Cl.[7] ..... H01R 13/62

(52) U.S. Cl. ..... 439/160; 29/764; 29/750; 29/758; 439/152; 439/483

(58) Field of Search ..... 439/160, 152, 439/483; 29/762, 750, 758, 764, 752; D13/154

(56) References Cited

U.S. PATENT DOCUMENTS 3,540,106 A * 11/1970 Goldman ..... 29/268
4,290,193 A 9/1981 Anderton et al.
4,467,512 A * 8/1984 Modes ..... 29/237
4,805,298 A * 2/1989 Takahashi ..... 29/764
4,821,392 A * 4/1989 Layland, Jr. ..... 29/267
4,961,256 A * 10/1990 Faillace ..... 29/764
5,077,879 A * 1/1992 Haviv ..... 29/268
5,537,727 A * 7/1996 Mayer ..... 29/237
5,709,660 A * 1/1998 Doyle et al. ..... 604/116
D408,239 S * 4/1999 Steiner et al. ..... D8/54
6,401,571 B1 * 6/2002 Schuman ..... 81/53.1
6,487,942 B1 * 12/2002 Carter et al. ..... 81/426.5

FOREIGN PATENT DOCUMENTS

JP 2001-035592 2/2001

* cited by examiner

*Primary Examiner*—Gary Paumen
*Assistant Examiner*—Briggitte R. Hammond
(74) *Attorney, Agent, or Firm*—Wei Te Chung

(57) ABSTRACT

An extraction tab (1) is provided to extract an electrical connector (2) from a mating electrical device. The electrical connector includes a mating portion (20) and a retaining portion (21). The extraction tab includes an engaging portion (11) and a handling portion (12). The engaging portion has a bottom section (110) and a top section (111). The bottom section has an engaging hole (114) for engaging with the mating portion of the electrical connector. The top section has a first plate (112) and a second plate (113) connected with each other. The handling portion extends from the bottom section for receiving an extracting force for extracting the electrical connector from the mating electrical device.

12 Claims, 5 Drawing Sheets

EXTRACTION TAB FOR EXTRACTING ELECTRICAL CONNECTOR

CROSS-REFERENCE TO RELATED APPLICATION

This application is relevant to a co-pending patent application serial entitled "PULL TAB FOR EXTRACTING ELECTRICAL CONNECTOR", invented by Chia-Ming Kuo et al., and assigned to the same assignee of the present application.

BACKGROUND OF THE INVENTION

1. Field of the Invention

The present invention relates to an extraction tab, and more particularly, to an extraction tab for extracting an electrical connector from a mating electrical device which mates with the electrical connector.

2. Description of Prior Art

To comply with the current trend of light weight and compactness, many electrical devices tend to employ small connectors for transmitting signals. These connectors need to mate tightly with corresponding devices for transmitting signals reliably, which usually requires a great amount of applied force to extract these connectors from these devices when there is necessary to replace these connectors with other connectors for different applications. Their separation is normally accomplished by manually shaking the connectors (or perhaps with prying tools) when the connectors are pulled away from the devices. However, the shaking action to the connectors inevitably bends the contacts of the small connectors and damages the connectors and/or the devices. It is also difficult to manually pull a connector having a very small size.

In order to solve the above-mentioned problems, U.S. Pat. No. 4,961,256 discloses a conventional extraction tool. To separate an electrical connector from an electrical device, the extraction tool is inserted between the electrical connector and the electrical device. The tool is relatively thick so that it cannot be used for the present miniature electrical connector since there is no space large enough between the connector and the electrical device to accommodate the tool.

Japanese Publication for Laid-Open Patent Application No. 11-208461 discloses another conventional extraction tool for extracting an L-shape connector from a mating device. The L-shape connector includes a mating portion and a retaining portion extending perpendicularly from the mating portion for retaining a cable. The extraction tool defines an aperture surrounded by a peripheral portion for engaging with a mating portion of the connector. The peripheral portion exerts an extracting force on the mating portion when the connector is extracted. However, the extraction tool is assembled with the connector only by the aperture receiving the mating portion of the connector, after the connector is extracted from the mating device, the extraction tool easily falls from the connector.

Hence, an improved extraction tool is desired to overcome the disadvantages of the prior arts.

BRIEF SUMMARY OF THE INVENTION

The main object of the present invention is to provide an extraction tab for extracting an electrical connector from a mating electrical device with reliably assembling to the electrical connector.

An extraction tab in accordance with the present invention is used to extract an electrical connector from a mating electrical device. The electrical connector comprises a mating portion and a retaining portion extending perpendicularly from the mating portion for retaining a cable.

The extraction tab includes an engaging portion and a handling portion. The engaging portion has a bottom section and a top section. The bottom section has an engaging hole for engaging with the mating portion of the electrical connector. The top section includes a first plate and a second plate connected with each other. The handling portion extends from the bottom section for receiving an extracting force for extracting the electrical connector from the mating electrical device.

Other objects, advantages and novel features of the invention will become more apparent from the following detailed description of the present embodiment when taken in conjunction with the accompanying drawings.

DETAILED DESCRIPTION OF THE INVENTION

Figure 1:
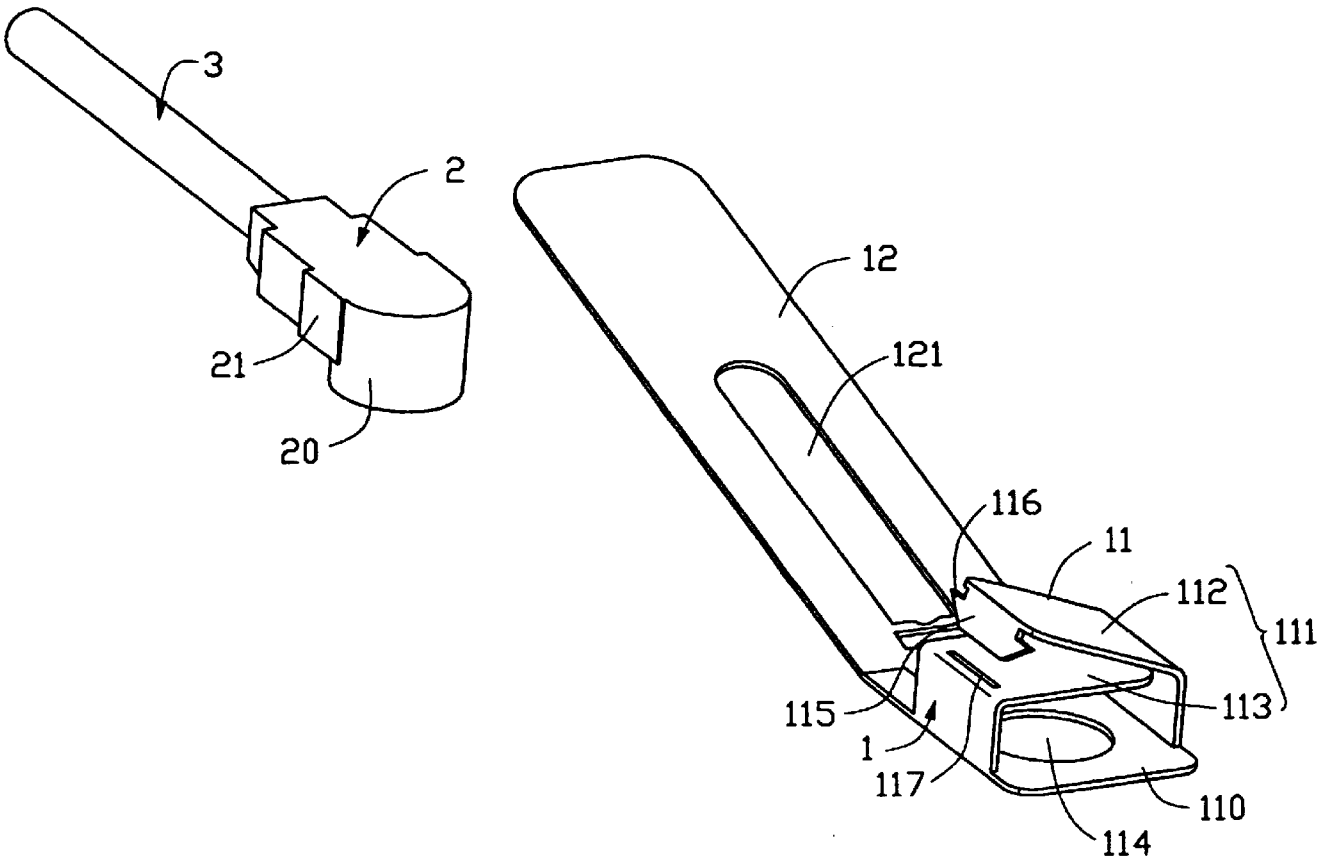
FIG. 1 is a perspective view of an extraction tab according to a first embodiment of the present invention and an electrical connector.
Figure 2:
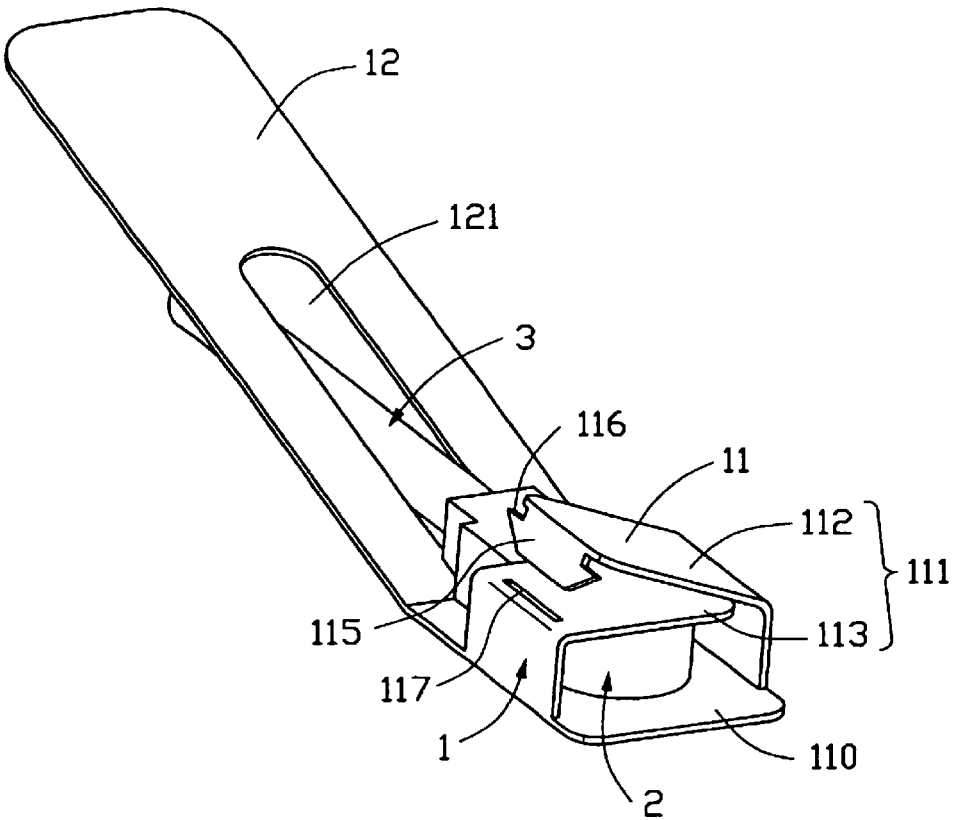
FIG. 2 is a partial-assembled view of the extraction tab of the FIG. 1 and the electrical connector.
Figure 3:
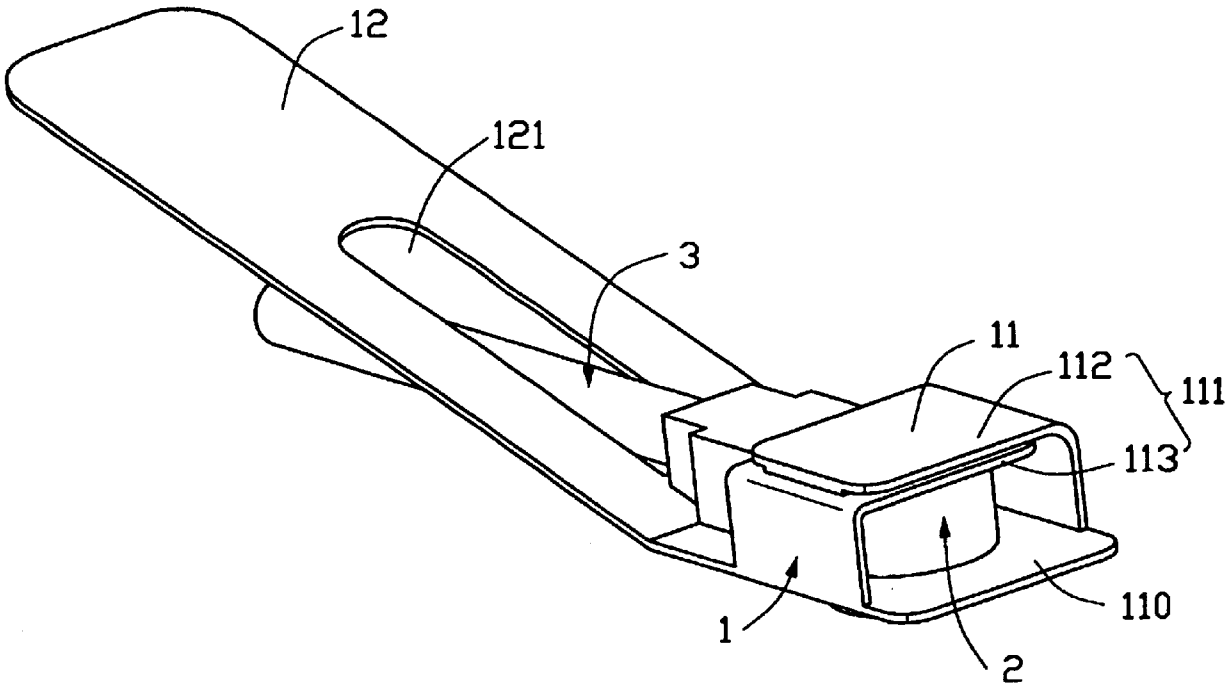
FIG. 3 is an assembled view of the extraction tab of the FIG. 2 and the electrical connector.

Referring to FIGS. 1, 2 and 3, an extraction tab 1 in accordance with the present invention is provided to extract an electrical connector 2 from a mating electrical device (not shown) which mates with the electrical connector 2. In this preferred embodiment, the electrical connector 2 is an RF (Radio Frequency) cable connector having an L-shape configuration.

The RF cable connector 2 comprises an upright mating portion 20 and a retaining portion 21 for retaining a cable 3. The retaining portion 21 extends horizontally and rearwardly from an upside of the mating portion 20.

The extraction tab 1 is made of a resilient dielectric material. The extraction tab 1 comprises a rectangular engaging portion 11 and a handling portion 12 extending rearwardly from the engaging portion 11. The engaging portion 11 has a bottom section 110, a top section 111 and two side sections (not labeled) connecting the bottom section 110 with the top section 111. The bottom section 110 defines a substantially circular hole 114 in a central portion thereof. The profile of the hole 114 is properly configured corresponding to an outer profile of a lower portion (not labeled) of the mating portion 20. Thus, the engaging portion 11 could firmly engage with the mating portion 20. The top section 111 has a first plate 112 and a second plate 113. A hook 115 projects downwardly from a free end of the first plate 112. A pair of barbs 116 project from two opposite sides of the hook 115. A slot 117 is defined in a side edge of the second plate 113 for receiving the hook 115. The first plate 112 is overlapped and connected reliably with the second plate 113 by the engagement of the hook 115 and the slot 117. The overlapped region of the first plate 112 and the second plate 113 lies over the mating portion 20 of the electrical connector 2. The handling portion 12 extends rearwardly and upwardly from the bottom section 110 with an obtuse angle relative to the bottom section 10. A notch 121 is defined in the handling portion 12 for receiving the cable 3.

In use, holding and upwardly pulling the handling portion 12 of the extraction tab 1, an extracting force is exerted on the handling portion 12. The extracting force is transferred to the electrical connector 2 by the engagement of the mating portion 20 and the hole 114, then upwardly pulls the electrical connector 2 out of the mating electrical device. Since the top section 110, the bottom section 111 and two side sections of the engaging portion 11 enclose the connector 2, after the electrical connector 2 is extracted from the mating electrical device, the extraction tab 1 can be reliably assembled with the connector 2.

Figure 4:
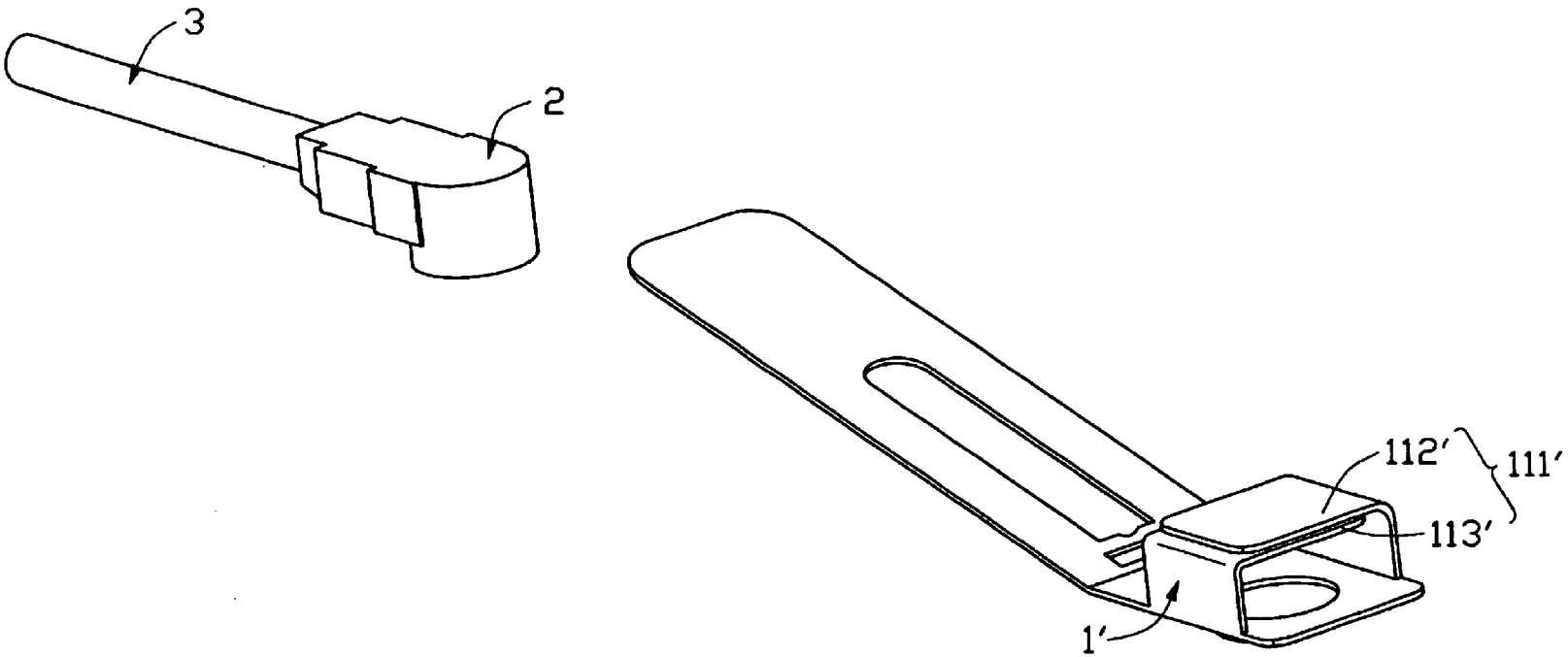
FIG. 4 is a perspective view of an extraction tab according to a second embodiment of the present invention and the electrical connector.
Figure 5:
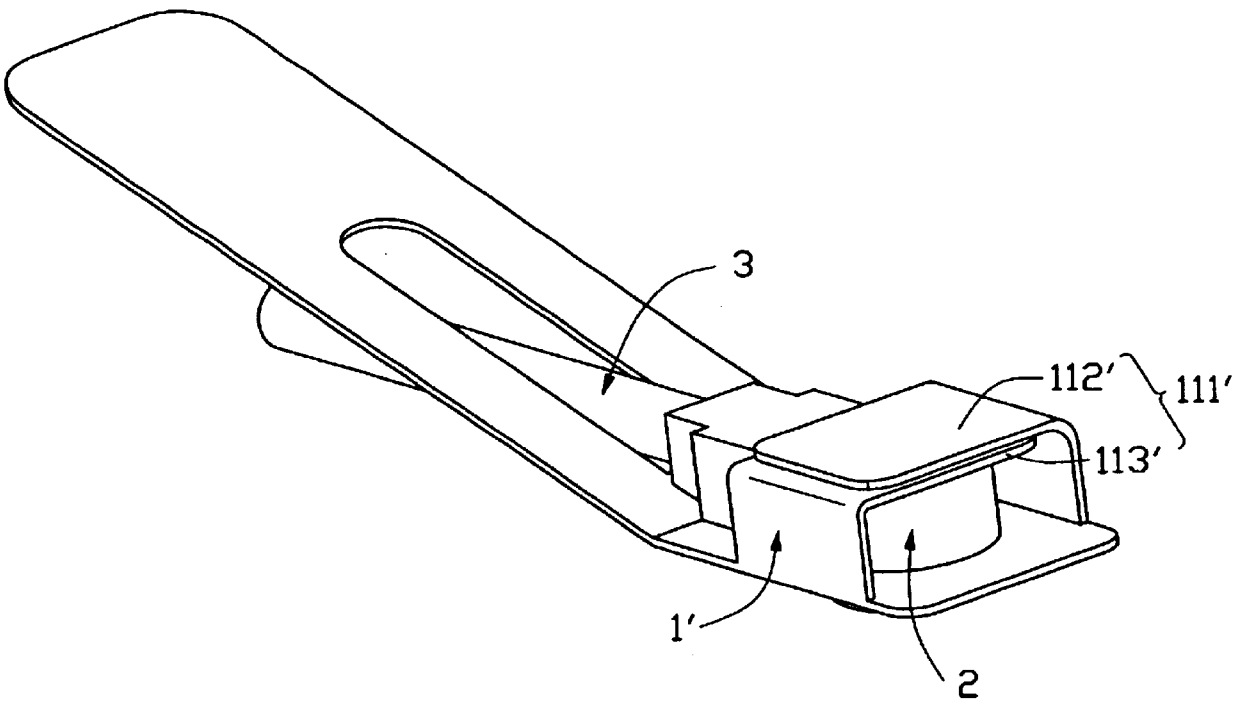
FIG. 5 is an assembled view of the extraction tab of the FIG. 4 and the electrical connector.

FIGS. 4 and 5 show an extraction tab 1' according to a second embodiment of the present invention and the electrical connector 2 retaining the cable 3. In the second embodiment the first plate 112' and the second plate 113' of the top section 111' are adhered together by adhesive tape or other adhesive material for preventing them from separating in use instead of the engagement of the hook 115 and the slot 117 of the first embodiment. Because the structure of the second embodiment is substantially same with the first embodiment, a detailed description thereof is omitted.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An extraction tab for extracting a connector from a mating electrical device, the connector comprising a mating portion and a retaining portion extending from the mating portion for retaining a cable, the extraction tab comprising:

an engaging portion having a top section and a bottom section enclosing the connector, the top section having a first plate and a second plate connected with each other, the bottom section having an engaging hole for receiving the mating portion of the connector; and a handling portion extending from the bottom section and being adapted for receiving an extracting force for extracting the connector from the mating electrical device, wherein the first plate has a hook projecting from a free end thereof, and the second plate has a slot for engaging with the hook.

2. The extraction tab as described in claim 1, wherein the hook forms a pair of barbs on two opposite sides thereof.

3. The extraction tab as described in claim 1, wherein the first plate and the second plate are adhered together by adhesive tape for preventing them from separating.

4. The extraction tab as described in claim 1, wherein the extraction tab is made of a resilient dielectric material.

5. The extraction tab as described in claim 1, wherein the handling portion extends rearwardly and upwardly from the bottom section of the engaging portion.

6. The extraction tab as described in claim 5, wherein the handling portion has a notch for receiving the cable.

7. An electrical connector assembly comprising:

an electrical connector comprising a mating portion and a retaining portion extending from the mating portion; and an extraction tab for extracting the electrical connector from a mating electrical device which mates with the electrical connector, the extraction tab comprising:

an engaging portion having a top section and a bottom section enclosing the electrical connector, the top section having a first plate and a second plate connected with each other, the bottom section having an engaging hole for receiving the mating portion of the connector; and a handling portion extending from the bottom section and being adapted for receiving an extracting force for extracting the connector from the mating electrical device, wherein the first plate has a hook projecting from a free end thereof, and the second plate has a slot for engaging with the hook.

8. The electrical connector assembly as described in claim 7, wherein the hook forms a pair of barbs on two opposite sides thereof.

9. The electrical connector assembly as described in claim 7, wherein the first plate and the second plate are adhered together by adhesive tape for preventing them from separating.

10. The electrical connector assembly as described in claim 7, wherein the extraction tab is made of a resilient dielectric material.

11. The electrical connector assembly as described in claim 7, wherein the handling portion extends rearwardly and upwardly from the bottom section of the engaging portion.

12. The electrical connector assembly as described in claim 11, wherein the handling portion has a notch for receiving a cable retained with the retaining portion.

* * * * *